US011828136B2

(12) United States Patent
De Long et al.

(10) Patent No.: US 11,828,136 B2
(45) Date of Patent: Nov. 28, 2023

(54) WAX REMOVAL IN A PRODUCTION LINE

(71) Applicant: Halliburton Energy Services, Inc., Houston, TX (US)

(72) Inventors: Robert Charles De Long, Sand Springs, OK (US); Donn J. Brown, Broken Arrow, OK (US); Ketankumar Kantilal Sheth, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 1041 days.

(21) Appl. No.: 16/664,015

(22) Filed: Oct. 25, 2019

(65) Prior Publication Data

US 2021/0123322 A1 Apr. 29, 2021

(51) Int. Cl.
*E21B 37/00* (2006.01)
*E21B 43/12* (2006.01)

(52) U.S. Cl.
CPC ..... *E21B 37/00* (2013.01); *E21B 43/128* (2013.01); *E21B 43/121* (2013.01)

(58) Field of Classification Search
CPC ..... E21B 37/00; E21B 43/128; E21B 43/121
See application file for complete search history.

(56) References Cited

U.S. PATENT DOCUMENTS 5,361,631 A * 11/1994 Covington ..... E21B 49/005 73/61.62
5,620,048 A 4/1997 Beauquin
6,206,093 B1 3/2001 Lee et al.
2004/0168811 A1* 9/2004 Shaw ..... E21B 37/06 166/368
2004/0206508 A1* 10/2004 Chan ..... E21B 33/068 166/312
2007/0059166 A1* 3/2007 Sheth ..... F04D 1/066 415/199.1
2007/0107907 A1* 5/2007 Smedstad ..... E21B 33/0355 166/357

(Continued)

OTHER PUBLICATIONS

PCT Application Serial No. PCT/US2019/058228, International Search Report, dated Jul. 21, 2020, 3 pages.

(Continued)

*Primary Examiner* — Tara Schimpf
*Assistant Examiner* — Neel Girish Patel
(74) *Attorney, Agent, or Firm* — DELIZIO, PEACOCK, LEWIN & GUERRA

(57) ABSTRACT

In artificial lift production systems, a reduction in pressure and temperature as production fluids migrate to the surface can cause a buildup in the production tubing that reduces or stops production. To remove buildup, an ESP can be operated at low efficiency and low flow operating conditions to generate heat in the pump. The heat increases the temperature of the production fluid in the pump. When the heated production fluid is transported to the surface, the fluid increases the temperature of the production tubing resulting in a melting of the solidified wax blocking the production tubing. As the wax melts, the production fluid carries it toward the surface. Over time, the heated production fluid will melt enough solidified wax to open the production tubing to a full flow capacity, thus allowing standard production operation to continue.

20 Claims, 5 Drawing Sheets

(56) References Cited

U.S. PATENT DOCUMENTS

| | | | | |
|---|---|---|---|---|
| 2007/0289740 | A1* | 12/2007 | Thigpen | E21B 43/14 166/250.01 |
| 2008/0257544 | A1* | 10/2008 | Thigpen | E21B 43/14 166/250.01 |
| 2008/0262736 | A1* | 10/2008 | Thigpen | E21B 43/128 702/9 |
| 2009/0071646 | A1 | 3/2009 | Pankratz et al. | |
| 2013/0175030 | A1* | 7/2013 | Ige | G05B 15/02 700/282 |
| 2013/0220616 | A1* | 8/2013 | Seth | E21B 43/24 166/300 |
| 2014/0262245 | A1 | 9/2014 | Hill et al. | |
| 2015/0000900 | A1* | 1/2015 | O'Malley | E21B 47/107 166/250.01 |
| 2022/0316308 | A1* | 10/2022 | Arceneaux | E21B 43/267 |

OTHER PUBLICATIONS

PCT Application Serial No. PCT/US2019/058228, International Written Opinion, dated Jul. 21, 2020, 6 pages.

* cited by examiner

WAX REMOVAL IN A PRODUCTION LINE

BACKGROUND

The disclosure generally relates to the field of earth or rock drilling, and more particularly to controlling or monitoring flow of a production fluid.

In artificial lift production wells, the wellbore environment creates a reduction in pressure and temperature of the production fluids as the fluids migrate to the surface of the wellbore. These conditions allow for solidification of material, particularly paraffin wax and asphaltenes, in production tubing. As the material solidifies, it separates from the fluid and precipitates on components of the production tubing. Precipitation of materials on the production tubing components can lead to a blockage that restricts or prohibits production. The blockage can be removed by chemical, mechanical, or thermal processes. In these situations, a shutdown of the artificial lift system may be required to remove the blockage.

BRIEF DESCRIPTION OF THE DRAWINGS

Embodiments of the disclosure may be better understood by referencing the accompanying drawings.

DESCRIPTION

Figure 1:
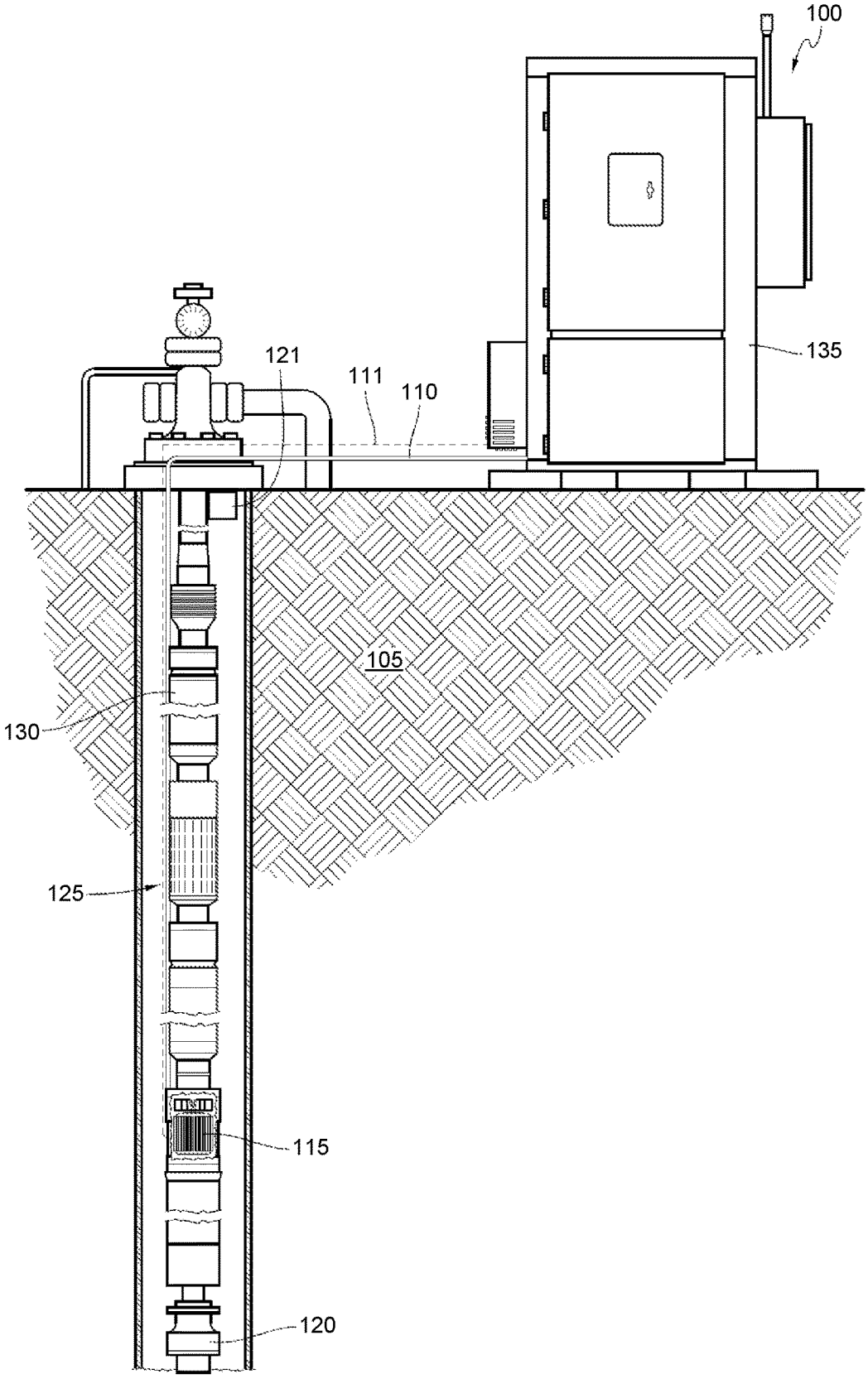
FIG. 1 depicts a production tubing temperature control system for heating substances in a production tubing string of an electrical submersible pump.

The description that follows includes example systems, methods, techniques, and program flows that embody embodiments of the disclosure. However, it is understood that this disclosure may be practiced without these specific details. For instance, this disclosure refers to removing wax in the production line of an electrical submersible pump in illustrative examples. Aspects of this disclosure can be also applied to remove other solid deposits in the production line such as scale or asphaltenes. In other instances, well-known instruction instances, protocols, structures and techniques have not been shown in detail in order not to obfuscate the description.

Overview

The blockage that occurs in the production tubing of artificial lift production wells can be removed by cleaning the production tubing through chemical methods or removing the blocked production tubing and reinstalling new production tubing. Both methods of removing the blockage are expensive and time consuming, resulting in a loss of production time. The artificial lift system integrity can be compromised during the removal process, reducing the reliability of the system. In addition, chemical methods of removing wax buildup present human and environmental safety concerns.

Electrical submersible pumps (ESPs), which are already used in artificial lift production, can be operated to remove the wax buildup in the production tubing using existing surface and down hole hardware without the need for chemical treatment or removal of the production tubing. To remove buildup, an ESP can be operated at low efficiency and low flow operating conditions. The operation at low flow and low efficiency results in transferring the inefficient energy in the form of heat to the production fluid, generating hot production fluid in the pump. Higher pump speeds at low flow are more inefficient due to generation of increased losses, which leads to increased heat generation. The heat generated due to inefficiencies increases the temperature of the production fluid in the pump. When the heated production fluid is transported to the surface, the fluid increases the temperature of the production tubing resulting in a melting of the solidified wax blocking the production tubing. As the wax melts, the production fluid carries it toward the surface. Over time, the heated production fluid will melt enough solidified wax to open the production tubing to a full flow capacity, thus allowing standard production operation to continue.

When a controller of the ESP system receives either a signal or a combination of signals indicating low flow, low amp, and/or low temperature, indicating the presence of wax deposits in the production tubing, a low efficiency cycle program is started. Although operating at low efficiency, the ESP can be controlled to operate in a cyclic process to remove wax without negatively affecting the ESP. A logic controller in a variable frequency drive (VFD) manages a cyclic flow of temperature and pressures within the wellbore. The VFD controls the cycle alternating between a phase having a high temperature and a low flow rate and a phase having a low temperature and a high flow rate. The production fluid moves slowly during the high temperature, low flow phase to allow the production fluid to attain heat from the pump operating at low efficiency. Once the production fluid is heated, the high flow, low temperature phase quickly transports the heated production fluid through the wellbore towards the surface. Several repeated cycles allow for the removal of solidified wax from the production tubing without negatively affecting the ESP motor due to operation at low efficiency.

Using existing hardware to heat production fluid and melt solidified wax in the production tubing eliminates workovers associated with removing and reinstalling ESP equipment in a well. A workover to remove and replace ESP equipment is expensive and results in lost production time. Thus, this technique is both more time and cost effective than other mechanical methods of removing the blockage from the production tubing. This disclosed use of ESPs also eliminates the environmental and human safety concerns associated with chemical cleaners.

Example Illustrations

FIG. 1 depicts a production tubing buildup removal system that heats substances in a production tubing string with an electrical submersible pump. A system 100 may be at the surface of an underground formation 105. The system 100 may be informationally coupled to an ESP power cable 110 that, in addition to providing power to an ESP motor 115, may also carry information from downhole gauges 120 (sensors) to the system 100. In some embodiments, information from the downhole gauges 120 may be transmitted on a dedicated cable separate from the ESP power cable 110. ESP assembly 125 may include an ESP pump 130, which may for example be a multi-stage centrifugal pump that lifts oil, natural gas and/or water to the surface of the underground formation 105 using stacked impeller and diffuser stages. The downhole gauges 120 may measure, for example, information such as motor rpm, vibration in one, two, or three axes, intake pressure, discharge pressure, gauge temperature, and/or other variables. Pump flow rate may be inferred from differential pressures when a discharge pressure transducer is included. Motor voltages and power consumption may be measured at the surface by the system 100 and motor efficiencies may be calculated from the measurements obtained. A VFD 135 may house a programmable logic controller (PLC) (not shown) which operates as a VFD controller. The PLC may be a VFD controller written in ladder-logic and may include a user interface.

Removing wax buildup from a production tubing string is a cyclical process. The system 100 is a mechanical system for various phases in the cycle. This system 100 includes the VFD 135, the ESP assembly 125, and temperature indicators 121. The VFD 135 includes a control logic that starts and stops the heating process. For the heating cycle, the logic controller in the VFD 135 receives an indication of a blockage in the production tubing. The indication can be in the form of a reduced flow rate at the surface or a predetermined start/stop control based on historical well data. Upon receiving the blockage indication, the VFD 135 changes the motor frequency sent to the ESP motor 115 through a control signal 111. The control signal 111 may be transmitted through the ESP cable 110, another cable (not shown), or wirelessly.

Temperature indicators 121 on the production tubing at the surface monitor the production tubing temperature change. The production tubing temperature directly relates to the fluid temperature exiting the well. The VFD 135 sends another control signal 111 to the ESP motor 115 to increase the frequency control parameter to the ESP motor 115 based on the temperature of the production fluid at the wellhead as indicated by the temperature indicators 121, thus allowing the ESP motor 121 to return to a normal operational efficiency and cool down. This process of operating the ESP assembly at low efficiency to heat production fluid can be repeated until the blockage is removed, indicated by an increased flow rate at the surface or a predetermined start/stop control times.

Figure 2:
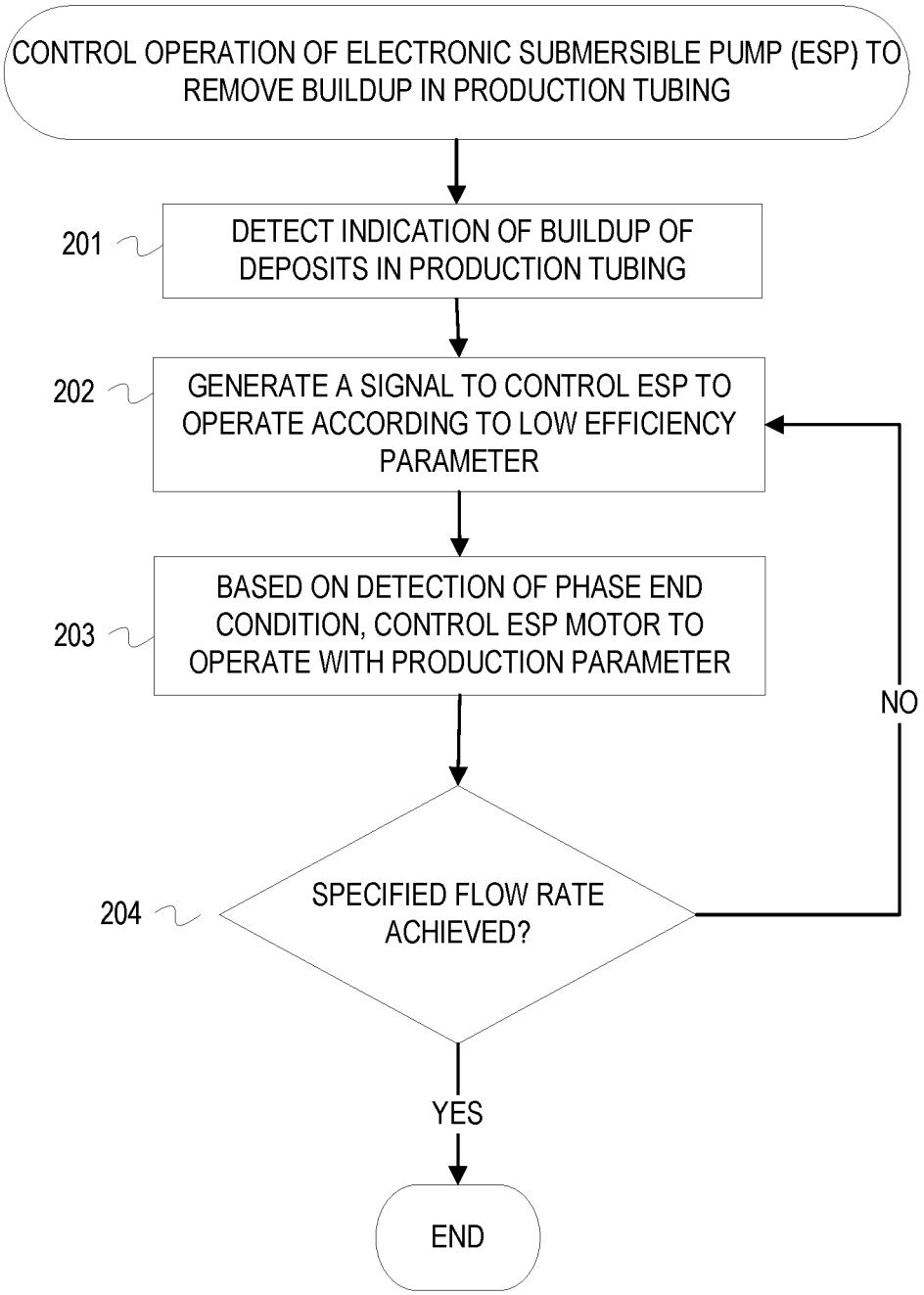
FIG. 2 depicts a flowchart of operations for removing wax from a production tubing string using an electrical submersible pump.

FIG. 2 depicts a flowchart of operations for removing wax from a production tubing string using an electrical submersible pump. FIG. 2 includes operations that can be performed by hardware, software, firmware, or a combination thereof. For example, at least some of the operations can be performed by a processor executing program code or instructions. The description refers to the program code that performs some of the operations as a "buildup removal system" although it is appreciated that program code naming and organization can be arbitrary, language dependent, and/or platform dependent. Operations of the flowchart of FIG. 2 start at block 201.

At block 201, a buildup removal system detects an indication of a buildup of deposits in a production tubing. The indication may be a signal indicating low efficiency operating conditions, or an expiration of a time period associated with production tubing blockage. Based on domain knowledge and/or historical data, the buildup removal system can be configured with time periods corresponding to expected buildup in the production tubing. When the time period expires, the buildup removal system triggers the ESP to operate according to a low efficiency parameter(s). Likewise, domain knowledge and/or historical operating data for the well can be used to set (and adjust) the time period for running the ESP in the low efficiency mode for buildup removal. For a low efficiency operating condition, the buildup removal system detects an indication of the blockage based on sensors of the well system. Sensors at a well head monitor flow rates as production fluid exits the wellbore. A decrease in the flow rates detected by the sensors indicates a buildup of wax, asphaltenes, or other solidified materials may be present in the production tubing.

At block 202, the buildup removal system generates a signal to instruct a VFD to operate an ESP with a set of one or more low efficiency parameters for the ESP. For instance, the buildup removal system selects a low efficiency motor frequency and communicates the low efficiency motor frequency to the VFD. The buildup removal system may send a communication to lower the motor frequency instead of communicating a specific motor frequency. In another instance, the buildup removal system may send a communication to increase the motor frequency instead of communicating a specific motor frequency. In response to the motor input frequency, the VFD changes the motor frequency of a motor controlled by the VFD. During normal operation, the motor is run at a frequency corresponding to optimal efficiency. The exact frequency that produces optimal efficiency varies by motor and system specifics. The changed motor frequency causes the pump to change the operating speed, generating heat. The VFD may cause the ESP motor to step up or step down through multiple motor frequencies until achieving a particular motor frequency corresponding to the low efficiency operating parameter. When the ESP operates according to the low efficiency parameter, the total flow rate of the production fluid is reduced. The reduced frequency of the motor causes a reduction in the production flow rate of the production fluid. The total flow rate is reduced to allow the production fluid to reach the surface at a low flow rate. The flow rate depends on the size of the pump and the motor and the specifics of the well. For example, the production fluid may reach the surface at a flow rate of only a few barrels per day (BPD). This low efficiency operation is performed for a short time period in a controlled manner to prevent the ESP from exceeding an internal operating temperature for prolonged time periods that can cause damage to the ESP. The relationship between flow rate and temperature increase is shown in FIG. 3.

Figure 3:
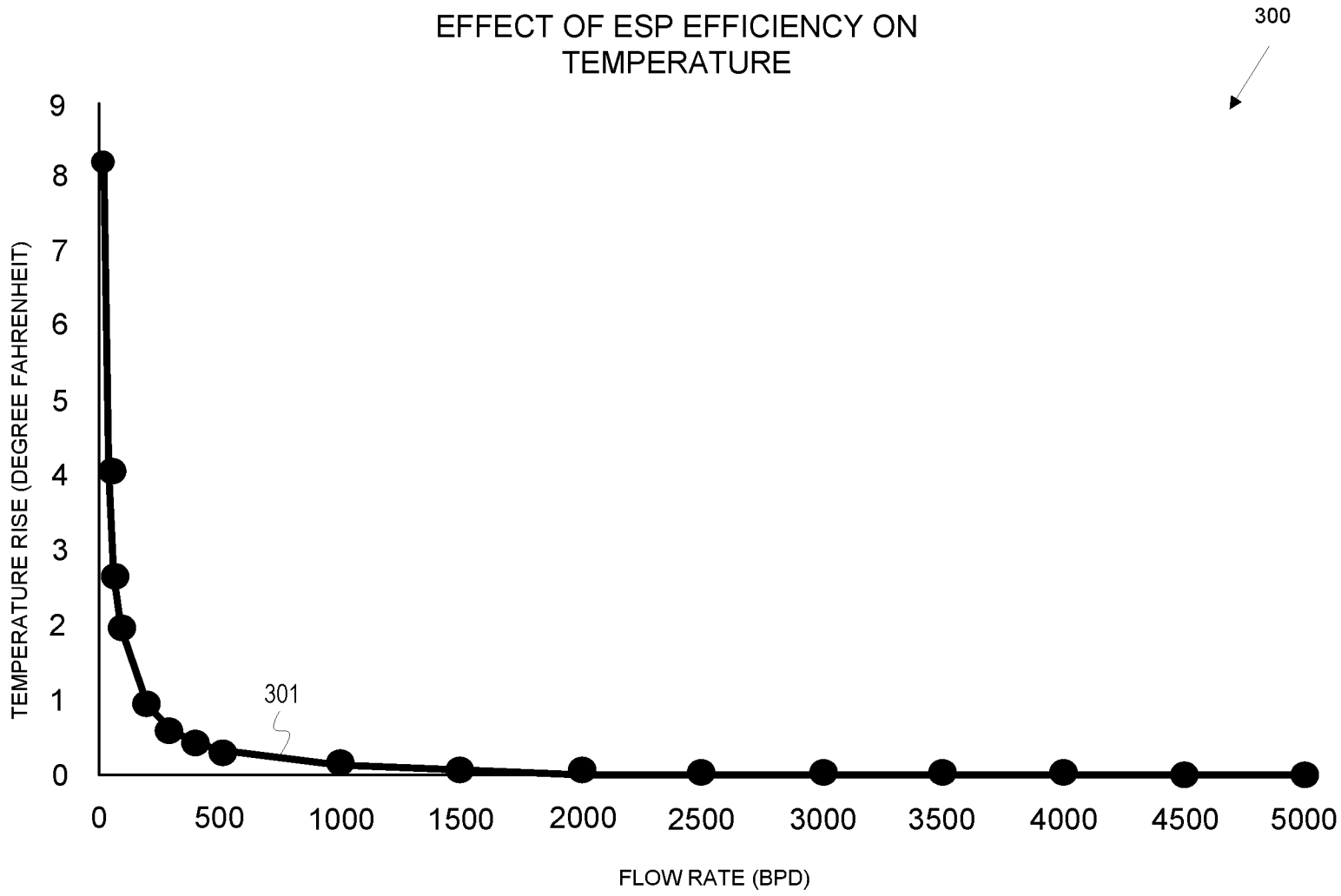
FIG. 3 depicts a graph of temperature increase due to electrical submersible pump efficiency.

FIG. 3 depicts a graph of temperature increase due to electrical submersible pump efficiency. A typical ESP system incorporates a centrifugal pump that has an efficiency curve that is very low at low production rates relative to the optimal efficiency of the motor. Graph 300 depicts the dependency of an increase in temperature in degrees Fahrenheit (y-axis) on a flow rate in BPD (x-axis). An example of a typical ESP efficiency curve is represented by curve 301. Curve 301 has a flow rate of zero at zero efficiency and a maximum flow rate at optimal efficiency. The relationship between the temperature increase in the ESP and the flow rate is represented by a power curve of the form A*flow rate$^B$, where A and B are constants related to the ESP system. Curve 301 shows the temperature increase is significant at very low flow rates, but quickly reduces to no temperature change as the flow rate approaches maximum efficiency and an open flow of a wellbore.

Returning to FIG. 2, the heat from the pump transfers into the production fluid as the production fluid passes through the pump at the low/lower flow rate. The low flow rate allows time for the production fluid to acquire a temperature that can melt solidified wax in the production tubing. Wellbore temperature, specific heat of the production fluid, amount of the production fluid and energy being put into the system all impact the temperature of the production fluid.

The time the ESP system is run at low efficiency controls the temperature change in the production fluid. The time to reach a specific temperature depends on the volume and material being heated. For example, a pump in a wellbore at 65° C. (~150° F.) may need to be heated to 220° C. (~430° F.) to melt the wax. Assuming the water volume in the pump is around 50% of the total volume of the pump, and the specific heat of water is ten times greater than the pump construction material, it will take approximately six minutes to raise the temperature of the pump to 220° C.

At block 203, the buildup removal system controls the ESP to operate according to one or more production parameters based on detection of a removal phase end trigger. Using the motor frequency as the operating parameter, the VFD changes the motor input frequency to a motor frequency previously designated as the operating parameter for production. The removal phase end or terminating condition may be time based, environmental measurement based, and/or both time and environmental measurement based. As an example, the terminating condition may be a specified temperature. Once the sensors measure temperature of the production fluid to be at or near (depending upon margin tolerance configuration) the terminating temperature condition, the VFD increases the motor frequency back to a stable operating frequency corresponding to maximum efficiency of the motor. The temperature of the motor and pump will return to the initial operating temperature as the ESP system works at optimal efficiency. Time can be another factor in determining when to control the ESP to operating according to production parameter(s). Different motors will have different tolerances and/or durability. Thus, time limits can be set to avoid undue wear on the motor from operating at a lower efficiency and/or cycling between production and removal operating parameters.

After controlling the ESP to operate according to a production parameter, the total flow rate of the production fluid is increased. As the motor speeds changes, fluid rate is increased resulting smaller total heat rise and the pump cools down, the pump will resume pumping at higher flow rates. The higher flow rates quickly send the heated production fluid toward the surface. The heated fluid melts away some of the solidified wax in the production tubing as it travels.

Figure 4:
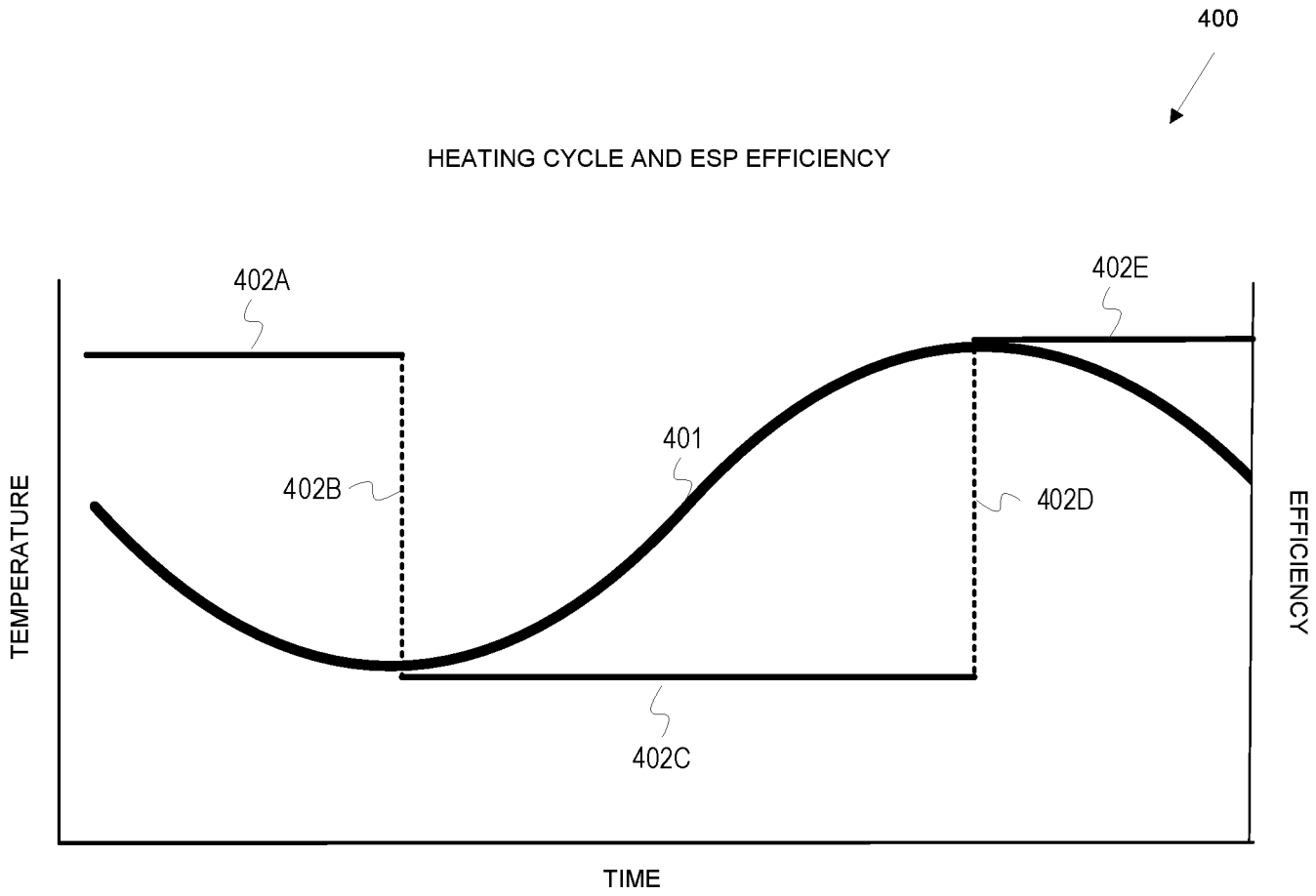
FIG. 4 depicts a graph of a wax heating cycle as electrical submersible pump efficiency changes.

At block 204, the buildup removal system determines whether the flow rate from the production tubing achieves a specified flow rate. This specified flow rate can be relative (e.g., improvement of a percentage or amount with respect to flow rate prior to heating cycle) or absolute (e.g., defined optimal flow rate). Depending on the degree of blockage in the production tubing, multiple rounds of heating may be required to achieve a desired/specified flow rate from the production tubing string. Operating an ESP system at low efficiency for extended periods of time may cause damage to the components of the ESP system. Thus, a cyclical process of operating the ESP system at low efficiency heats the fluid while operation at optimal efficiency allows the ESP system to cool down while the fluid is being transported. If the specified flow rate has not been achieved after a heating and cooling cycle of the ESP system, the cycle will start again at block 202. This cycle will be repeated until the specified flow rate has been achieved or a maximum number of cycles for heating/cooling have been run within a given time period (e.g., 10 cycles per day to avoid undue wear on the ESP). FIG. 4 depicts an example of a typical heating cycle of an ESP throughout operation of the buildup removal system.

FIG. 4 depicts a graph of a wax heating cycle as electrical submersible pump efficiency changes. Graph 400 depicts the dependence of temperature of the pump temperature on time. Temperature function 401 represents the temperature of the pump over time. Temperature function 401 follows a sine wave pattern. The efficiency relationship is represented by a step-wise function composed of multiple phases of high efficiency and low efficiency. The efficiency function is comprised of phases 402A-402E, collectively referred to as function 402. Phases 402A and 402E represent high efficiency while phase 402 C represents low efficiency. Phases 402 B and 402D represent the rapid change in motor speed associated with the VFD sending a control signal to change the motor speed. While the efficiency function 402 experiences sharp changes at a specific point in time, the temperature function 401 experiences gradual increases and decreases in response to the change in efficiency. During phases of high efficiency, the temperature of the pump gradually decreases, allowing particulates in the production fluid to solidify and deposit within the production tubing. During periods of low efficiency, the pump attains heat and, thus, heats the production fluid in the production tubing.

Over time, under normal operating conditions, wax is likely to build up in the production tubing and cause another blockage. This low efficiency cycling can be repeated multiple times throughout the production process as new wax buildup blocks the production tubing string.

While this cycle is described as using a blocking indication from a sensor to determine when to start and stop the heating cycle, it should also be appreciated that this could be performed by an automated process which considers the history of the well. In this instance, the cycle could be scheduled to start based on historical data of how much time occurs between blockages. By scheduling the heating cycle to occur regularly at shorter intervals than the historical blockage times, blockages could be prevented and well production time increased.

Figure 5:
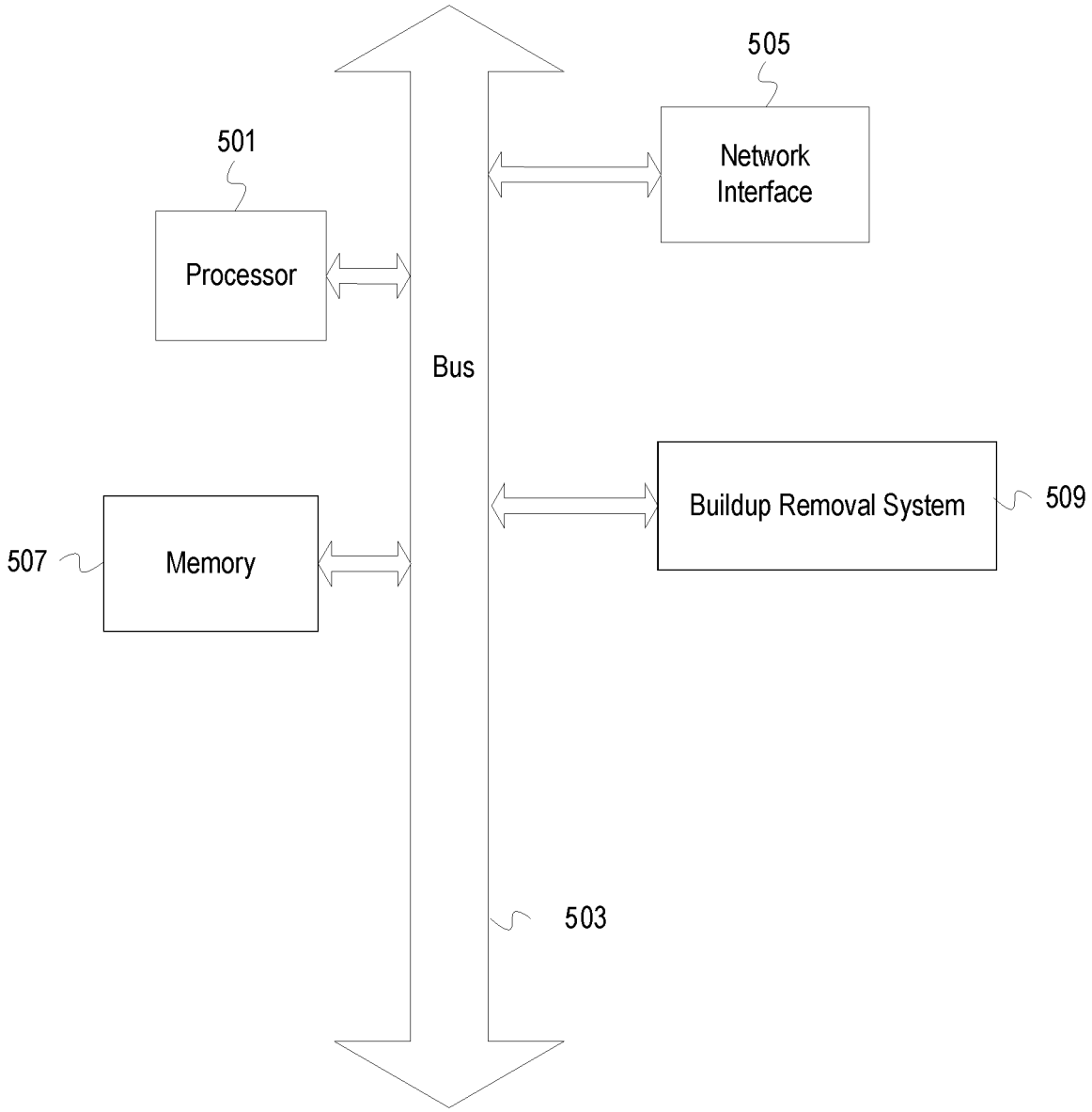
FIG. 5 depicts an example system that controls wax removal in a production tubing string.

FIG. 5 depicts an example system that controls wax removal in a production tubing string. The system includes a processor 501 (possibly including multiple processors, multiple cores, multiple nodes, and/or implementing multithreading, etc.). The system includes memory 507. The memory 507 may be system memory or any one or more of the above already described possible realizations of machine-readable media. The system also includes a bus 503 and a network interface 505. The processor 501, the memory 507, and the network interface may all be part of single variable frequency drive.

The system also includes a buildup removal system 509. The buildup removal system 509 may perform the function of controlling frequency signals to the motor. The buildup removal system comprises a buildup removal program contained in a programming logic controller installed in a VFD. Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 may be coupled to the processor 501.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for removing wax from a production tubing string as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

A method comprises detecting an indication of a buildup of deposits in a production tubing based on fluid flow rate in the production tubing of a well, controlling an electrical submersible pump (ESP) associated with the production tubing to operate according to a low efficiency parameter for a first time period, and, after the first time period, controlling the ESP to operate according to a production parameter that corresponds to a greater operating efficiency than an operating efficiency of the ESP corresponding to the low efficiency parameter.

Controlling the ESP to operate according to a low efficiency parameter comprises controlling a motor of the ESP to operate at a slower or a faster operational speed.

Controlling the ESP to operate according to the low efficiency parameter further comprises transmitting a control signal to the ESP motor.

Detecting an indication of a buildup of deposits comprises detecting at least one of an expiration of a specified time based on previously observed buildup time in the production tubing, an indication of blockage from buildup in the production tubing, and a reduced production fluid flow rate through the production tubing.

Controlling the ESP to operate according to the production parameter comprises changing the speed of a motor of the ESP to return the ESP to an optimal operating condition.

The method further comprises determining whether fluid flow rate has improved after controlling the ESP to operate according to the production parameter and, based on a determination that the fluid flow rate has not improved to a specified fluid flow rate, controlling the ESP to operate according to the low efficiency parameter or a different low efficiency parameter for the first time period and then controlling the ESP to operate according to the production parameter.

Controlling the ESP to operate according to the low efficiency parameters increases heat generation by the ESP and slows fluid flow to allow for heat transfer from the ESP to production fluid which then transfers to the production tubing to remove deposition of at least one of paraffin wax, scale, asphaltenes, or other solid deposits.

A system comprises an electrical submersible pump, a variable frequency drive (VFD), and a computer-readable medium. The computer-readable medium has instructions stored thereon that are executable by the VFD to cause the system to detect an indication of a buildup of deposits in a production tubing based on fluid flow rate in the production tubing of a well, control the ESP associated with the production tubing to operate according to a low efficiency parameter for a first time period, and, after the first time period, control the ESP to operate according to a production parameter that corresponds to a greater operating efficiency than an operating efficiency of the ESP corresponding to the low efficiency parameter.

The instructions to control the ESP to operate according to a low efficiency parameter comprise instructions to control a motor of the ESP to operate at a different operational speed.

The instructions to control the ESP to operate according to the low efficiency parameter further comprise instructions to transmit a control signal to the ESP motor.

The instructions to control the ESP to operate according to the production parameter comprise instructions to change a speed of the motor of the ESP to return the ESP to an optimal operating condition.

The instructions to detect an indication of a buildup of deposits in the production tubing comprise instructions to detect at least one of an expiration of a specified time based on previously observed buildup time in the production tubing, an indication of blockage from buildup in the production tubing, and a reduced production fluid flow rate through the production tubing.

The instructions further cause the system to determine whether fluid flow rate has improved after controlling the ESP to operate according to the production parameter and, based on a determination that the fluid flow rate has not improved to a specified fluid flow rate, control the ESP to operate according to the low efficiency parameter or a different low efficiency parameter for the first time period and then control the ESP to operate according to the production parameter.

The instructions to control the ESP to operate according to the low efficiency parameters increase heat generation by the ESP and slow fluid flow to allow for heat transfer from the ESP to production fluid which then transfers to the production tubing to remove deposition of at least one of paraffin wax, scale, asphaltenes, or other solid deposits.

A non-transitory, computer-readable medium has instructions stored thereon that are executable by a computing device to perform operations comprising detecting an indication of a buildup of deposits in a production tubing based on fluid flow rate in the production tubing of a well, controlling an electrical submersible pump (ESP) associated with the production tubing to operate according to a low efficiency parameter for a first time period, and, after the first time period, controlling the ESP to operate according to a production parameter that corresponds to a different operating efficiency than an operating efficiency of the ESP corresponding to the low efficiency parameter.

The instructions for controlling the ESP to operate according to a low efficiency parameter comprise instructions for controlling a motor of the ESP to operate at a different operational speed.

The instructions for detecting an indication of a buildup of deposits in a production tubing comprise instructions for detecting at least one of an expiration of a specified time based on previously observed buildup time in the production tubing, an indication of blockage from buildup in the production tubing, and a reduced production fluid flow rate through the production tubing.

The instructions for controlling the ESP to operate according to the production parameter comprise instructions for changing a speed of a motor of the ESP to return the ESP to an optimal operating condition.

The non-transitory, computer-readable medium further comprises instructions to perform operations comprising determining whether fluid flow rate has improved after controlling the ESP to operate according to the production parameter and, based on a determination that the fluid flow rate has not improved to a specified fluid flow rate, controlling the ESP to operate according to the low efficiency parameter or a different low efficiency parameter for the first time period and then controlling the ESP to operate according to the production parameter.

The instructions for controlling the ESP to operate according to the low efficiency parameters increases heat generation by the ESP and slows fluid flow to allow for heat transfer from the ESP to production fluid which then transfers to the production tubing to remove deposition of at least one of paraffin wax, scale, asphaltenes, or other solid deposits.

What is claimed is:

1. A method comprising:

detecting an indication of a buildup of deposits in a production tubing based on fluid flow rate in the production tubing of a well;

controlling an electrical submersible pump (ESP) associated with the production tubing to operate according to a low efficiency parameter for a first time period to increase a temperature of the production tubing to remove the buildup of deposits in the production tubing; and after the first time period, controlling the ESP to operate according to a production parameter that corresponds to a greater operating efficiency than an operating efficiency of the ESP corresponding to the low efficiency parameter.

2. The method of claim 1, wherein controlling the ESP to operate according to the low efficiency parameter comprises controlling a motor of the ESP to operate at a slower or a faster operational speed.

3. The method of claim 2, wherein controlling the ESP to operate according to the low efficiency parameter further comprises transmitting a control signal to the ESP motor.

4. The method of claim 1, wherein detecting the indication of the buildup of deposits comprises detecting at least one of an expiration of a specified time based on previously observed buildup time in the production tubing, an indication of blockage from buildup in the production tubing, and a reduced production fluid flow rate through the production tubing.

5. The method of claim 1, wherein controlling the ESP to operate according to the production parameter comprises changing a speed of a motor of the ESP to return the ESP to an optimal operating condition.

6. The method of claim 1 further comprising:

determining whether the fluid flow rate has improved after controlling the ESP to operate according to the production parameter; and based on a determination that the fluid flow rate has not improved to a specified fluid flow rate, controlling the ESP to operate according to the low efficiency parameter or a different low efficiency parameter for the first time period; and controlling the ESP to operate according to the production parameter.

7. The method of claim 1, wherein controlling the ESP to operate according to the low efficiency parameters increases heat generation by the ESP and slows fluid flow to allow for heat transfer from the ESP to production fluid which then transfers to the production tubing to remove deposition of at least one of paraffin wax, scale, asphaltenes, or other solid deposits.

8. A system comprising:

an electrical submersible pump (ESP);

a variable frequency drive (VFD); and a computer-readable medium having instructions stored thereon that are executable by the VFD to cause the system to, detect an indication of a buildup of deposits in a production tubing based on fluid flow rate in the production tubing of a well;

control the ESP associated with the production tubing to operate according to a low efficiency parameter for a first time period to increase a temperature of the production tubing to remove the buildup of deposits in the production tubing; and after the first time period, control the ESP to operate according to a production parameter that corresponds to a greater operating efficiency than an operating efficiency of the ESP corresponding to the low efficiency parameter.

9. The system of claim 8, wherein the instructions to control the ESP to operate according to the low efficiency parameter comprise instructions to control a motor of the ESP to operate at a different operational speed.

10. The system of claim 9, wherein the instructions to control the ESP to operate according to the low efficiency parameter further comprise instructions to transmit a control signal to the ESP motor.

11. The system of claim 9, wherein the instructions to control the ESP to operate according to the production parameter comprise instructions to change a speed of the motor of the ESP to return the ESP to an optimal operating condition.

12. The system of claim 8, wherein the instructions to detect the indication of the buildup of deposits in the production tubing comprise instructions to detect at least one of an expiration of a specified time based on previously observed buildup time in the production tubing, an indication of blockage from buildup in the production tubing, and a reduced production fluid flow rate through the production tubing.

13. The system of claim 8, wherein the instructions further cause the system to:

determine whether the fluid flow rate has improved after controlling the ESP to operate according to the production parameter; and based on a determination that the fluid flow rate has not improved to a specified fluid flow rate, control the ESP to operate according to the low efficiency parameter or a different low efficiency parameter for the first time period; and control the ESP to operate according to the production parameter.

14. The system of claim 8, wherein the instructions to control the ESP to operate according to the low efficiency parameters increases heat generation by the ESP and slows fluid flow to allow for heat transfer from the ESP to production fluid which then transfers to the production tubing to remove deposition of at least one of paraffin wax, scale, asphaltenes, or other solid deposits.

15. A non-transitory, computer-readable medium having instructions stored thereon that are executable by a computing device to perform operations comprising:

detecting an indication of a buildup of deposits in a production tubing based on fluid flow rate in the production tubing of a well;

controlling an electrical submersible pump (ESP) associated with the production tubing to operate according to a low efficiency parameter for a first time period to increase a temperature of the production tubing to remove the buildup of deposits in the production tubing; and after the first time period, controlling the ESP to operate according to a production parameter that corresponds to a different operating efficiency than an operating efficiency of the ESP corresponding to the low efficiency parameter.

16. The non-transitory, computer-readable medium of claim 15, wherein the instructions for controlling the ESP to operate according to the low efficiency parameter comprise instructions for controlling a motor of the ESP to operate at a different operational speed.

17. The non-transitory, computer-readable medium of claim 15, wherein the instructions for detecting the indication of the buildup of deposits in a production tubing comprise instructions for detecting at least one of an expiration of a specified time based on previously observed buildup time in the production tubing, an indication of blockage from buildup in the production tubing, and a reduced production fluid flow rate through the production tubing.

18. The non-transitory, computer-readable medium of claim 15, wherein the instructions for controlling the ESP to operate according to the production parameter comprise instructions for changing a speed of a motor of the ESP to return the ESP to an optimal operating condition.

19. The non-transitory, computer-readable medium of claim 15, further comprising instructions to perform operations comprising:

determining whether the fluid flow rate has improved after controlling the ESP to operate according to the production parameter; and based on a determination that the fluid flow rate has not improved to a specified fluid flow rate, controlling the ESP to operate according to the low efficiency parameter or a different low efficiency parameter for the first time period; and controlling the ESP to operate according to the production parameter.

20. The non-transitory, computer-readable medium of claim 15, wherein the instructions for controlling the ESP to operate according to the low efficiency parameters increases heat generation by the ESP and slows fluid flow to allow for heat transfer from the ESP to production fluid which then transfers to the production tubing to remove deposition of at least one of paraffin wax, scale, asphaltenes, or other solid deposits.

* * * * *